US008644727B2

(12) United States Patent
Vines et al.

(10) Patent No.: US 8,644,727 B2
(45) Date of Patent: Feb. 4, 2014

(54) THERMAL AGGLOMERATION OF TONER IN LASER CARTRIDGES TO AID RECYCLING

(76) Inventors: Robert Vines, Horizon City, TX (US); Lacee L. Lamphere, El Paso, TX (US); Donald L. Laffler, El Paso, TX (US); James T. Hardin, Corona, NM (US)

( * ) Notice: Subject to any disclaimer, the term of this patent is extended or adjusted under 35 U.S.C. 154(b) by 0 days.

(21) Appl. No.: 13/603,267

(22) Filed: Sep. 4, 2012

(65) Prior Publication Data

US 2013/0058680 A1 Mar. 7, 2013

Related U.S. Application Data

(60) Provisional application No. 61/531,977, filed on Sep. 7, 2011.

(51) Int. Cl.
*G03G 15/00* (2006.01)

(52) U.S. Cl.
USPC ..... 399/109; 399/111

(58) Field of Classification Search
CPC ..... G03G 5/00
USPC ..... 241/19; 264/140; 399/109
See application file for complete search history.

(56) References Cited

U.S. PATENT DOCUMENTS

| | | | | |
|---|---|---|---|---|
| 6,568,612 | B1 * | 5/2003 | Aoki et al. | 241/19 |
| 7,252,250 | B2 * | 8/2007 | Morriss et al. | 241/19 |
| 7,736,827 | B2 * | 6/2010 | Morii et al. | 430/111.31 |
| 8,128,010 | B2 * | 3/2012 | Sabe | 241/24.11 |
| 8,193,403 | B2 * | 6/2012 | DeWhitt | 585/241 |
| 2002/0028087 | A1 * | 3/2002 | Higeta et al. | 399/109 |
| 2005/0179153 | A1 * | 8/2005 | Riise et al. | 264/40.1 |
| 2006/0151497 | A1 * | 7/2006 | Underwood | 220/200 |
| 2013/0039675 | A1 * | 2/2013 | Holmes et al. | 399/109 |
| 2013/0058680 | A1 * | 3/2013 | Vines et al. | 399/109 |
| 2013/0119575 | A1 * | 5/2013 | Whaley et al. | 264/140 |

FOREIGN PATENT DOCUMENTS

| | | | | |
|---|---|---|---|---|
| DE | EP0661609 | * 12/1994 | | G03G 15/08 |

OTHER PUBLICATIONS

Chen, J., Heitmann, J. A., Chang, H.-M., Hubbe, M. A., and Venditti, R. A., "The Effect of Paper Additives on Toner Agglomeration during the Recycling Process," Prog. Paper Recyling 13 (14): 16-23 (2004).*

* cited by examiner

*Primary Examiner* — Clayton E LaBalle
*Assistant Examiner* — Kevin Butler
(74) *Attorney, Agent, or Firm* — J. Todd Rushton

(57) ABSTRACT

A low cost batch or continuous toner agglomeration process for laser printer toner cartridges that virtually eliminates generation of airborne toner and that provides associated health and safety benefits. The residual powdered toner in cartridges is solidified in a clean, low cost thermal agglomeration process.

11 Claims, No Drawings

THERMAL AGGLOMERATION OF TONER IN LASER CARTRIDGES TO AID RECYCLING

This application claims priority to U.S. Provisional Application 61/531/977 filed Sep. 7, 2011, the entire disclosure incorporated by reference.

BACKGROUND

Laser printer and copier toner cartridges are made from materials that may be safely and economically recycled, but only when suitable processes are developed and utilized. Unfortunately today, toner cartridge recycling operations are not as safe or as environmentally friendly as they should be. The current processes are often uneconomical and may not survive without subsidies. This state of affairs exists because there are issues concerning health, safety and economics in the existing processes that need to be improved.

Safety and health issues arise when residual toner in cartridges is liberated and becomes airborne, during the recycling process. The amount of airborne toner must be monitored and controlled in order to avoid fires and explosions and to limit exposure of personnel to respiratory complications from inhalation of toner dust. Economic issues arise from the high cost of operations that provide the requisite safety and that produce clean and pure streams of recovered materials that must be produced in order to earn the best salvage prices.

Currently, the most common method of recycling toner cartridges is to remove residual toner, demolish the cartridges by crushing or shredding and then sorting the resultant materials into reusable categories. The salvaged material categories generally include major amounts of a few types of engineering plastics, toner, steel and aluminum and minor amounts of a few other types of metal and plastic. The materials are sorted by operations that vary from totally manual to totally automated identification and separation systems. Properly cleaned and separated materials can be sold at prices that offset a significant part of the cost of the recycling operation.

Recycling of printer toner cartridges can be hazardous. The hazard primarily results from the requirement to remove and process residual toner. Toner consists mostly of plastic plus small amounts of carbon black or other colorants and minor amounts of additives that enhance the toner's storage and performance characteristics, e.g. to make the toner ferromagnetic, etc. Toner components are generally prepared as finely divided powders that can become airborne if disturbed. Once airborne, toner may be inhaled by exposed and unprotected personnel. Though toner materials are generally considered non-toxic to humans, if inhaled, the finely powdered materials can go deeply into one's lungs where, over time, they may cause irritation, breathing discomfort, or even more serious respiratory problems.

Even so, the greatest hazard may not be to health but rather safety. Safety is at issue because toner is flammable and it is readily suspended in air in concentrations sufficient to support combustion. In that state it can be easily ignited and result in serious explosions or fires.

Some recyclers are managing health and safety hazards by providing operating personnel respirators and by removing toner from cartridges before crushing or shredding. These recyclers often use the toner handling procedures developed by toner cartridge manufacturers. While these procedures have been proven effective, they typically involve expensive equipment and high operation and maintenance costs. These costs often cannot be recovered from the sale of the recycled materials and the operations have to be subsidized to survive.

Other recyclers have developed an automated method that removes and collects the residual toner in an inert atmosphere. This method reduces labor costs but introduces costs for the inert gases consumed in the process as well as higher costs for equipment and maintenance. Both methods capture toner in filters that also require regular replacement and disposal of the spent filters and dry toner.

The safest and least expensive toner cartridge recycling method that has been developed avoids handling dry powdered toner entirely; U.S. Pat. No. 7,999,012 filed Oct. 20, 2008, to Lamphere. It processes toner cartridges in a non-flammable fluid environment. This method captures most of the toner in the process fluid. The fluid is then filtered and returned to the process.

The toner captured in the process fluid is removed by filters as a damp sludge or cake. Toner is completely safe to handle in this form and thus it can be delivered into a wider range of applications than dry powdered toner.

SUMMARY OF THE INVENTION

The methods described above are considered safe but the special processes required to handle powdered toner make the recovered materials so expensive that operations often cannot be supported by the recycled materials market. The result is that without subsidies, a high percentage of used toner cartridges end up in the environment, hopefully in secure landfills.

It is the objective of this invention to describe a novel, low cost batch or continuous toner agglomeration process for laser printer toner cartridges that virtually eliminates generation of airborne toner and that provides associated health and safety benefits. The residual powdered toner in cartridges is solidified in a clean, low cost thermal agglomeration process. The solidified toner is converted into granular form, along with the other cartridge components, in a typical crushing or shredding operation. The granulated toner is separated along with the other salvaged plastic materials, using traditional low cost methods.

Granular toner is the preferred form for use in almost all applications because it eliminates the health and safety problems experienced in handling dry, powdered toner. Thus, toner can be safely offered for use in a large number of applications that increases the opportunity for profit.

The described agglomeration process utilizes the inherent thermal solidification property of toner whereby it becomes tacky and bonds together at a fairly low temperature, e.g. less than 150° F. This property is used to convert residual powdered toner contained in cartridges into a weak, chalky or loosely coalesced matrix or even a relatively strong solid plastic mass, depending on the temperature and time profile to which the cartridges are exposed. When determining the temperature and time profile, the environmental conditions such as ambient temperature and humidity may be considered, as well as, the initial condition of the toner cartridges to be destroyed. Where cartridges have been exposed to moisture or other contaminates it may be necessary to increase temperature and kiln dwell time to achieve complete toner agglomeration. It is understood that temperature and kiln dwell time may also be adjusted if the chemical or material makeup of printer toner is changed in the future due to cost, safety, environmental or technological considerations. In one embodiment of the present invention, the toner cartridges are heated to a temperature less than 150 degree Fahrenheit. In another embodiment, the printer toner cartridges are heated to 150 degrees Fahrenheit. In yet another embodiment of the present invention, the printer toner cartridges are heated to a temperature greater than 150 degrees Fahrenheit and less than a temperature determined to melt the cartridge structure or to cause combustion of the kiln contents.

Thermal agglomeration is accomplished as a continuous or as a batch process. It can be implemented as a prelude to most existing toner cartridge recycling processes. Toner agglomeration permits conventional shredding or crushing operations to safely produce a residual toner product that is separated from the other cartridge materials by conventional salvage processes.

This invention relates to improvements in the art of safely and economically recycling products that contain certain types of potentially hazardous materials, by crushing, shredding, grinding and so forth. By way of example, it is desired to demolish printer toner cartridges by shredding. The cartridges may contain various amounts of residual toner that may cause processing problems and create health and safety hazards. During conventional handling and processing, residual toner can become airborne where, under certain conditions, it can ignite and cause serious fires and explosions. In addition, airborne toner can be a health risk if it is inhaled by exposed personnel.

This invention uses a low temperature kiln batch heater or a continuous heating device, such as a pass through furnace, to raise the temperature of cartridges above the temperature where the residual toner component agglomerates, i.e. becomes tacky and congeals. The process heats and converts the powdered toner in the cartridges into a more or less solid mass. The consistency of the solidified toner depends on the particular temperature and time profile to which it is exposed. The agglomerated residual toner in the cartridges can be processed without liberating significant airborne toner during the shredding and sorting operations used for recovering the cartridge's other plastic and metal materials.

It is understood that the process and method described may have many yet unidentified applications and that describing it for recycling printer toner cartridges is for illustration purposes and is not intended to limit its utility.

The invention is implemented using commercially available components and equipment. The equipment is arranged to safely, efficiently and reliably solidify the toner and to shred, separate and otherwise process cartridge materials.

Major Processing Equipment List

For example the recovery operation might be accomplished by the following major processing equipment:

1. Agglomeration Batch Kiln or a Continuous Flow Through Furnace
2. Shredder
3. Ferrous Metal Separator
4. High Specific Gravity Plastics Separator
5. Low Specific Gravity Plastics Separator
6. Non-Ferrous Metal Separator
7. Plastic Material Granulator
8. Granulated High Specific Gravity Plastic Separator
9. Granulated Low Specific Gravity Plastic Separator
10. Plastic Material Washer
11. Plastic Material Dryer
12. Plastics Tolling Equipment
13. Bulk Packaging Equipment

The invention claimed is:

1. A method for handling and recovery of powdered printer toner, along with other cartridge materials, by thermal agglomeration prior to processing comprising:

loading cartridges having residual toner into a heated chamber;

heating the cartridges to a predetermined temperature, and;

removing the cartridges from the heated chamber.

2. The method of claim 1 including maintaining the predetermined temperature for a predetermined interval sufficient to cause agglomeration of the residual toner.

3. The method of claim 1 wherein the cartridges are passed through the heated chamber.

4. The method of claim 1 wherein the predetermined temperature and predetermined interval are set by testing.

5. The method of claim 1 wherein the cartridges are processed immediately following removal from the heated chamber.

6. The method of claim 1 wherein the cartridges are allowed to cool prior to processing.

7. The method of claim 1 wherein the residual toner is agglomerated into a loosely coalesced matrix.

8. The method of claim 1 wherein the residual tone is agglomerated into a plastic mass.

9. The method of claim 1 wherein the predetermined temperature is less than 150 degrees Fahrenheit.

10. The method of claim 1 wherein the predetermined temperature is 150 degrees Fahrenheit.

11. The method of claim 1 wherein the predetermined temperature is more than 150 degrees Fahrenheit.

* * * * *